US010485277B2

(12) United States Patent
Pilon

(10) Patent No.: US 10,485,277 B2
(45) Date of Patent: Nov. 26, 2019

(54) NECK PROTECTIVE APPARATUS AND A METHOD OF USING SAME

(71) Applicant: Turtle Neck Sports Apparel, Calgary (CA)

(72) Inventor: Jeff Pilon, Calgary (CA)

(73) Assignee: TURTLE NECK SPORTS APPAREL, Calgary (CA)

( * ) Notice: Subject to any disclaimer, the term of this patent is extended or adjusted under 35 U.S.C. 154(b) by 84 days.

(21) Appl. No.: 15/820,924

(22) Filed: Nov. 22, 2017

(65) Prior Publication Data

US 2018/0343937 A1 Dec. 6, 2018

Related U.S. Application Data

(60) Provisional application No. 62/425,259, filed on Nov. 22, 2016.

(51) Int. Cl.

| | |
|---|---|
| ***A41D 13/05*** | (2006.01) |
| ***A63B 71/12*** | (2006.01) |
| *A63B 102/24* | (2015.01) |
| *A41D 13/015* | (2006.01) |
| *A63B 102/14* | (2015.01) |

(52) U.S. Cl.

CPC ..... *A41D 13/0512* (2013.01); *A63B 71/1291* (2013.01); *A41D 13/015* (2013.01); *A41D 13/0153* (2013.01); *A63B 71/12* (2013.01); *A63B 2102/14* (2015.10); *A63B 2102/24* (2015.10); *A63B 2209/00* (2013.01); *A63B 2209/14* (2013.01); *A63B 2210/50* (2013.01)

(58) Field of Classification Search

CPC ..... A42B 3/06; A42B 3/0473; A41D 13/0512
USPC ..... 2/468
See application file for complete search history.

(56) References Cited

U.S. PATENT DOCUMENTS

| | | | | |
|---|---|---|---|---|
| 4,338,685 | A * | 7/1982 | LaPorta, Jr. | A63B 71/12 2/462 |
| 4,821,339 | A * | 4/1989 | Fair | A41D 13/0153 2/102 |
| 4,996,720 | A * | 3/1991 | Fair | A41D 13/0512 2/44 |
| 5,483,698 | A * | 1/1996 | Douglas, Jr. | A41D 13/0512 2/462 |
| 6,195,802 | B1 * | 3/2001 | Armellino | A41D 13/00 2/102 |
| 8,914,918 | B2 * | 12/2014 | Swanson | A41D 13/0512 2/468 |
| 2014/0020163 | A1 * | 1/2014 | Stiles | A42B 3/0473 2/468 |

* cited by examiner

*Primary Examiner* — Tajash D Patel
(74) *Attorney, Agent, or Firm* — William W. Cochran; Cochran Freund & Young

(57) ABSTRACT

A protective apparatus for protecting at least a user's neck area from impact forces directed thereto, has a neck-protective structure about the neck area at a distance for bearing and absorbing the impact forces, and a base structure coupled to the protective structure. The protective structure is demountably attachable to an upper body area of the user for supporting the protective structure thereon and for absorbing the impact forces absorbed distributed from the protective structure.

20 Claims, 17 Drawing Sheets

NECK PROTECTIVE APPARATUS AND A METHOD OF USING SAME

CROSS-REFERENCE TO RELATED APPLICATIONS

This application claims the benefit of U.S. Provisional Patent Application Ser. No. 62/425,259 filed Nov. 22, 2016, the content of which is incorporated herein by reference in its entirety.

FIELD OF THE DISCLOSURE

The present invention relates generally to a protective apparatus for upper body areas, and in particular to an apparatus for protecting a user's neck from forceful blows.

BACKGROUND

In contact sports such as football, hockey, ice hockey, indoor or outdoor lacrosse (also called box lacrosse or field lacrosse), soccer, and the like, protective equipment is often worn to protect players from blunt force injuries caused by blows from sports equipment and/or stationary objects into which they may be forced by contact during play. Examples of such protective equipment include helmets, eyeshields, protective clothing or apparels, chest protectors, padding such as shoulder pads, elbow pads, knee pads, jockstraps with hard plastic cup inserts, mouthguards, padded gloves, and the like.

For example, lacrosse is a fast-pace contact sport that requires exceptional eye and hand coordination along with the ability to sustain violent hits and cross-checking with playing sticks made of metal or other rigid materials. Box lacrosse is one of the fastest growing sports at both professional and amateur levels.

Lacrosse teaches and allows the players to cross-check (i.e., using the stick to push/hit the opponent in the back, side, and chest) when defending. Lacrosse uses a way of timing in each period, called run time, which means that the clock does not stop during play until a 15-minute quarter is over. The clock is not immediately stopped when a player is injured. Rather, when a player is injured, the clock is allowed to run up to four (4) minutes before the referees may stop the play clock. Being able to reduce the injury run-off time can help keep the flow of the game consistent, and allow a losing team to possibly make a comeback.

Lacrosse may be extremely dangerous to young players who have not developed the kinesthetic coordination to safely deliver and receive cross-checks. This can result in an opposing player's stick to slide up a player's shoulder and into their neck, resulting a direct blow to the unprotected neck. In youth lacrosse games (e.g., lacrosse games for players aged 5 to 18 yrs), the size of the players can vary greatly which increases the risks of neck injury to opposing players having less weight and/or insufficient kinesthetic coordination.

Currently available protective equipment, however, does not provide sufficient injury protection in many cases. For example, a player's neck area generally does not have sufficient protection against potential impact forces delivered thereto, which, as described above, may be caused by a stick wielded at or deflected thereto at high speed and force.

SUMMARY

According to one aspect, there is disclosed an apparatus for protecting a user's neck area from impact forces delivered thereto. The apparatus comprises: (i) a neck-protective structure for fastening about a user's neck area, for bearing and absorbing impact forces that may directed or alternatively, misdirected against the user's shoulder and neck area, and (ii) base structure coupled to the neck-protective structure to provide a support therefor, wherein the base structure is configured for demountable attachment to an upper body area of the user. The neck-protective structure may be integrally engaged with the base structure. Alternatively, the neck-protective structure may be demountably engaged with the base structure. The apparatus is configured to absorb impact forces delivered to the neck-protective structure and to distribute the impact forces away from the neck-protective structure to and along the base structure.

In some embodiments, the neck-protective structure may comprise a first rigid material. The first rigid material may be aluminum, steel, wood, hard plastic, rigid foam, carbon fiber, the like, and combinations thereof.

In some embodiments, the neck-protective structure may extend upwardly and outwardly at a first angle from at least two shoulder sides of the base structure away from the neck area.

In some embodiments, the neck-protective structure may extend upwardly and outwardly at a first angle from at least two shoulder sides of the base structure away from the neck area to a first height, and then may further extend upwardly and outwardly at a second angle away to a second height.

In some embodiments, the second angle is greater than the first angle, and the second height is higher than the first height.

In some embodiments, the base structure may comprise a second rigid material. The second rigid material may be aluminum, steel, wood, hard plastic, rigid foam, carbon fiber, the like, and combinations thereof.

In some embodiments, at least one of the neck-protective structure and the base structure may further comprise a cushion material.

In some embodiments, at least one of the neck-protective structure and the base structure may be enclosed in a fabric cover or alternatively, with a plastic or rubberized coating.

In some embodiments, the apparatus may further comprise one or two arm-protective structure(s) integrally coupled to the base structure. Alternatively, the one or two arm-protective structure(s) may be demountably coupled to the base structure.

In some embodiments, the apparatus may further comprise a neck and spinal column protection structure that is positionable along a user's neck and spinal column. The neck and spinal column protection structure may comprise a third rigid material. The third rigid material may be aluminum, steel, wood, hard plastic, solid foams, carbon fiber, the like, and combinations thereof.

In some embodiments, the neck and spinal column protection structure may further comprise a cushion material.

In some embodiments, the neck and spinal column protection structure may be enclosed in a fabric cover or alternatively, with a plastic or rubberized coating.

In some embodiments, the neck-protective structure may be integrally coupled to the base structure. Alternatively, the neck-protective structure may be demountably coupled to the base structure.

In some embodiments, the neck-protective structure may comprise a fastening structure for demountably coupling the neck-protective structure to the base structure.

In some embodiments, the base structure may comprise a front portion and a rear portion. Each of the front and rear portions may comprise a laterally extending base frame. The neck-protective structure may comprise a left-hand side neck-protective portion and a right-hand side neck-protective portion. Each of the left- and right-hand side neck-protective portions may comprise a protective frame coupled to the base frames.

In some embodiments, the base structure may be a protective apparel comprising at least a rigid portion for supporting the neck-protective structure.

According to another aspect, there is disclosed an apparatus for protecting a user's neck area from impact forces directed theretowards. The apparatus comprises a neck-protective structure demountably attachable to an upper body area of the user about the neck area at a distance, for bearing and absorbing the impact forces.

In some embodiments, the apparatus may further comprise a base structure coupled to the neck-protective structure and demountably attachable to the upper body area of the user for supporting the neck-protective structure and for absorbing the impact forces distributed from the neck-protective structure. The neck-protective structure may be demountably attachable to the upper body area of the user via the base structure.

DETAILED DESCRIPTION

Embodiments herein disclose a protective apparatus that may be demountably attached to a user's upper body and about the user's neck area. The protective apparatus comprises a base structure and a neck-protective structure extending upwardly and preferably slightly outwardly from two shoulder sides of the base structure.

The neck-protective structure is demountable about at least a portion of a user's neck area, and when worn by a user, is maintained at a distance from the neck area to bear and absorb impact forces, blows, and/or hits directed towards the user's neck. The neck-protective structure is made of a rigid material with sufficient strength such that it absorbs impact forces without significant deformation or transfer. The space between the neck-protective structure and the user's neck prevents the impact force being transferred to the neck, and also allows a limited deformation of the neck-protective structure for better impact resistance.

The absorbed impact force is transferred from the neck-protective structure to the base structure. The base structure is also made of a rigid material with sufficient strength to withstand deformation resulting from impact forces. The base structure supports the neck-protective structure and further absorbs the impact forces transferred thereto. The base structure may also distribute the received impact forces to the user's upper body for facilitating impact-force absorption. Therefore, the user's neck is protected from being injured by accidental impact forces or hits applied thereto.

Figure 1:
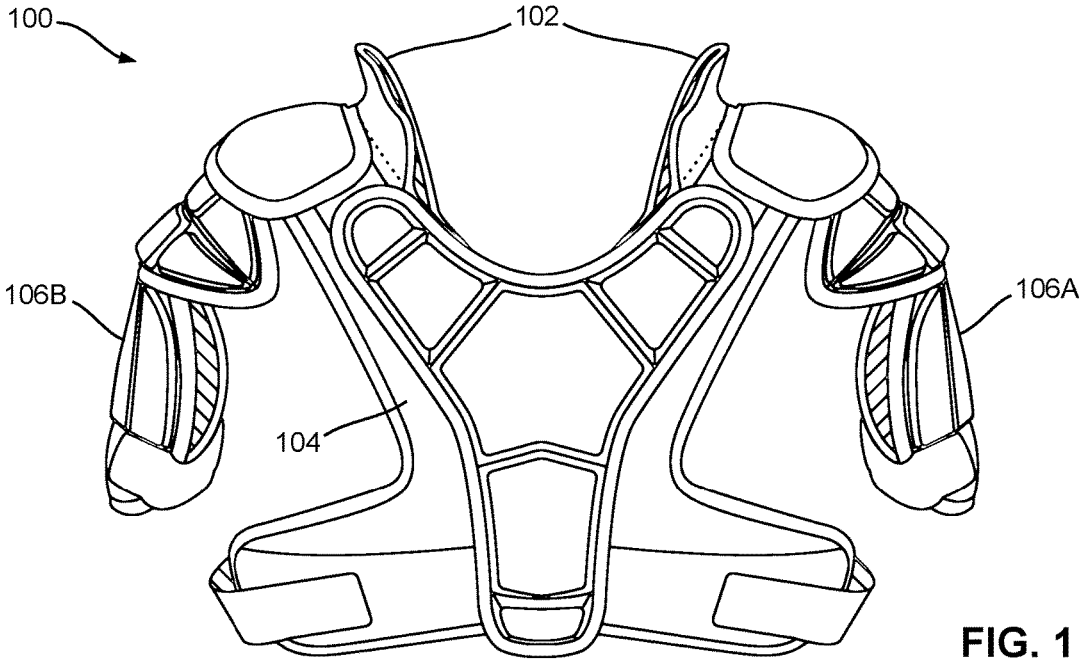
FIG. 1 is a front view of a protective apparatus, according to one embodiment of the present disclosure.
Figure 2:
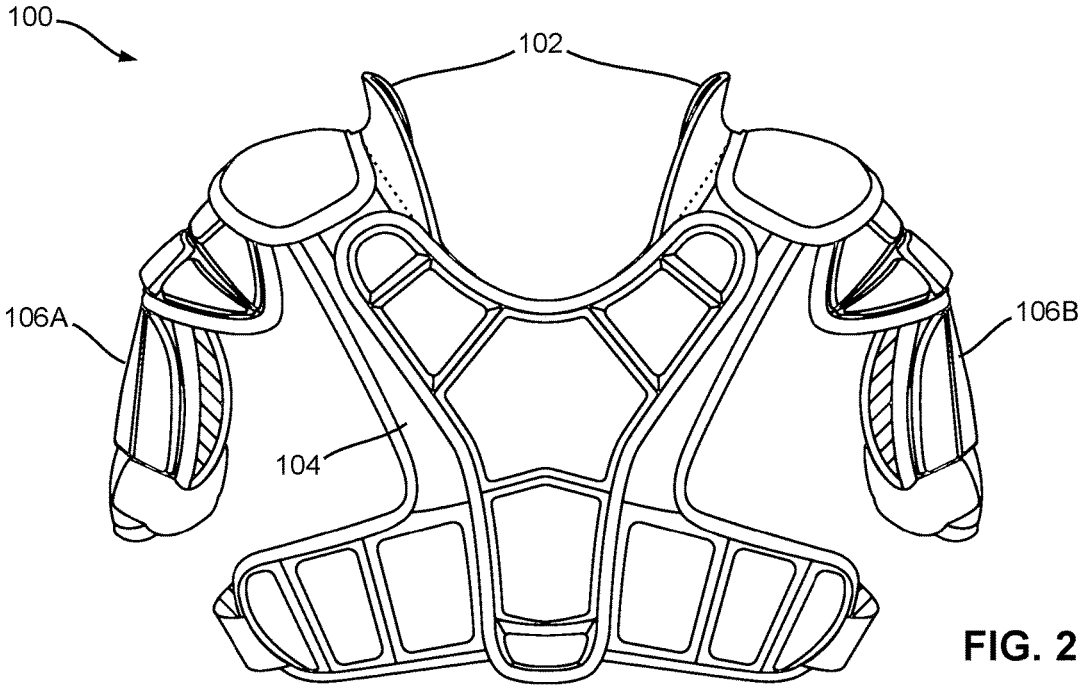
FIG. 2 is a rear view of the protective apparatus shown in FIG. 1.

Turning now to FIGS. 1 and 2, a protective apparatus in the form of a protective garment is shown and is generally identified using reference numeral 100. A user may wear the protective garment 100 upon his/her upper body to form protection about the user's body and neck area. As shown, the apparatus comprises a base structure 104 demountably engageable about the user's torso area, a neck-protective structure 102 demountably engageable about the user's neck area and demountably coupled to the base structure 104 by suitable means such as straps, screws, hooks, and/or the like. The protective garment 100 additionally comprises two arm-protective structures 106A and 16B, each configured for resting on an arm of the user and coupled to the base structure 104 by suitable means.

The neck-protective structure 102 bears and absorbs impact forces, blows or hits directed towards the user's neck area, and distributes the impact forces to the base structure 104 thereby protecting the user's neck from injury. The base structure 104 supports the neck-protective structure 102 and absorbs the impact forces received therefrom. As will be described in more detail later, the base structure 104 may also be configured to protect the user's upper body from impact forces, blows or hits directed thereto. The arm-protective structures 106A and 106B protect the user's arms from impact forces and injury.

Figure 3:
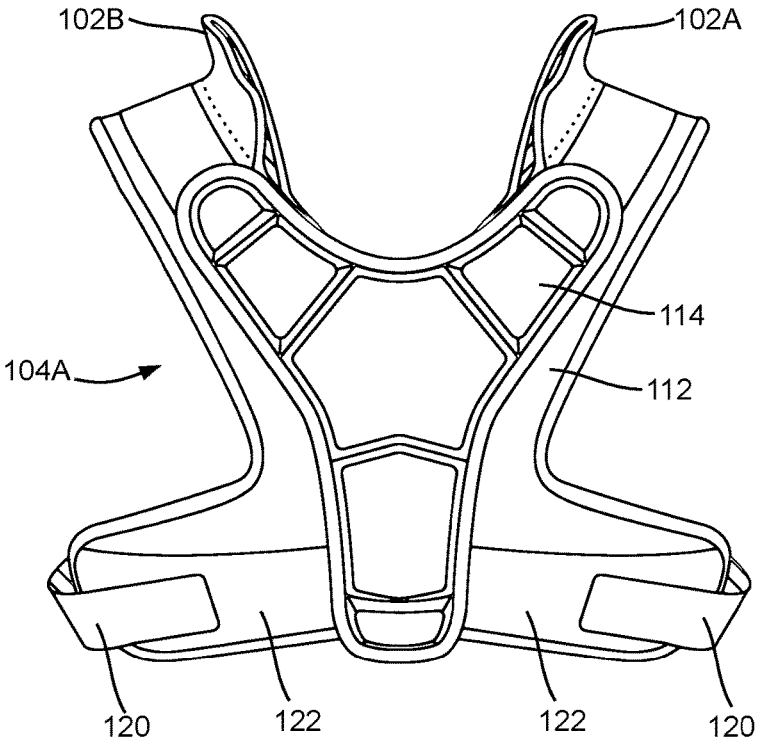
FIG. 3 is a front view of a base structure and a neck-protective structure of the protective apparatus shown in FIG. 1.
Figure 4:
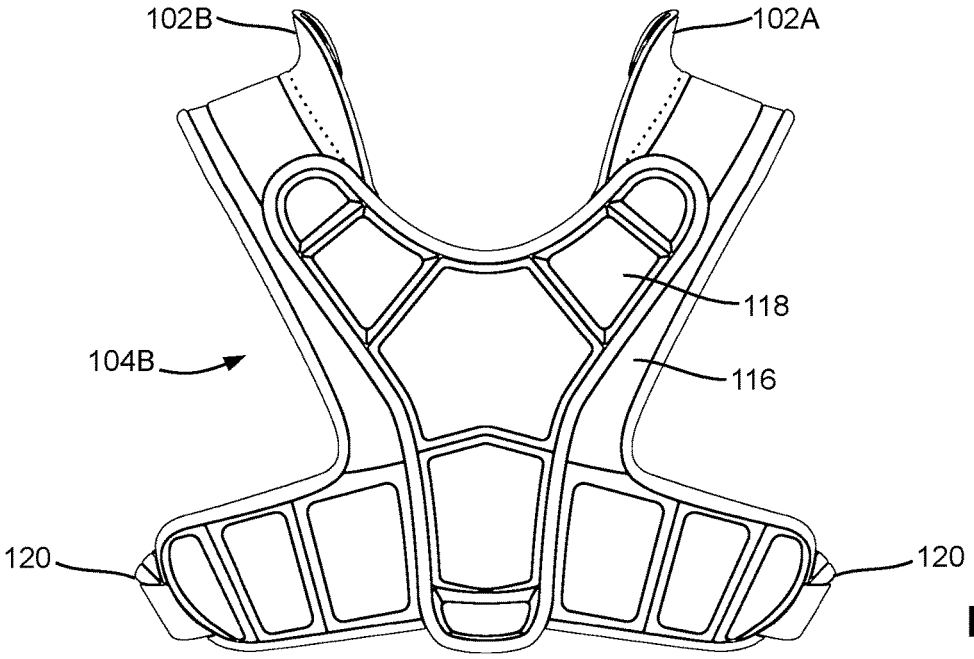
FIG. 4 is a rear view of the base structure and the neck-protective structure shown in FIG. 3.

In this embodiment, the neck-protective structure 102 is integrated with or permanently coupled to the base structure 104. As shown in FIGS. 3 and 4, the base structure 104 comprises a front portion 104A and a rear portion 104B. The front portion 104A comprises a front plate 112 for overlaying the user's chest area and a front sternum pad 114 attached to the front plate 112. The front plate 112 is made of a rigid foam sheet or plate enclosed in a fabric cover for protecting the user's chest area from injury and for providing a solid base to support the neck-protective structure 102. The front sternum pad 114 is made of a rigid foam base and a plurality of rigid foam blocks enclosed in a fabric cover for providing enhanced protection against impact forces applied to the front side of the user. Herein, the term "rigid" refers to a suitable material having a sufficient strength for resisting impact forces without significant deformation.

Similarly, the rear portion 104B comprises a rear plate 116 about the user's back area and a rear sternum pad 118 attached to the rear plate 116. The rear plate 116 is made of a rigid foam sheet enclosed in a fabric cover for protecting the user's back area from injury and for providing a solid base to support the neck-protective structure 102. The rear sternum pad 118 is made of a rigid foam base and a plurality of rigid foam blocks enclosed in a fabric cover for providing enhanced protection against impact forces directed to the rear side of the user.

In this embodiment, the base structure 102 also comprises a hook and loop fastener structure such as a VELCRO® flap (VELCRO is a registered trademark of Velcro Industries B. V., Curacao, Curacao), for fastening the front portion 104A to the rear portion 104B. For example, as shown in FIGS. 3 and 4, a pair of fastening strips 120 having tiny hooks extending from a lower portion of the rear plate 116 at two opposite sides thereof for releasably coupling to a pair of strips 122 having tiny loops on the front plate 112 at corresponding locations.

The neck-protective structure 102 in this embodiment comprises a left-hand side neck-protective portion 102A (also denoted as a left-hand side neck guard) and a right-hand side neck-protective portion 102B (also denoted as a right-hand side neck guard). Each neck guard 102A, 102B is curved about the user's neck area and extends upwardly and slightly outwardly from the left or right shoulder side of the base structure 104 at a first angle towards a direction away from the neck area for substantively adapting to the user's neck and head profile to allow the user to freely move their head. In this embodiment, each neck guard 102A, 102B comprises a plurality of rigid foam layers and a plastic outer layer enclosed in a fabric cover for providing impact resistance and for distributing received impact forces to the base structure 104. The curved shape of the neck guards 102A and 102B also provides enhanced impact resistance.

As described above, the neck-protective structure 102 in this embodiment is integrated to the base structure 104 such that the neck-protective structure 102 is solidly fixed to the base structure 104 without flexibility. Those skilled in the art will appreciate that the neck-protective structure 102 and/or the base structure 104 may experience a limited deformation when an impact force is directly applied to the neck-protective structure 102.

The integration of the neck-protective structure 102 and the base structure 104 may be achieved by any suitable means known to those skilled in this art. For example, in one embodiment, the neck-protective structure 102 may be fastened to the base structure 104 with rivets, screws, nails, glue, and/or the like. In another embodiment, the rigid foam sheets of the front and rear plates 112 and 116 may extend upwardly and slightly outwardly at the first angle from the shoulder area of the base structure 104 to form a supportive layer of the neck-protective structure 102. One or more rigid foam layers and a plastic outer layer may then attached to the supportive layer for enhancing the impact resistance properties of the neck-protective structure 102. A fabric cover may then enclose the components of the neck-protective structure 102 and the base structure 104 for comfort.

Figure 5:
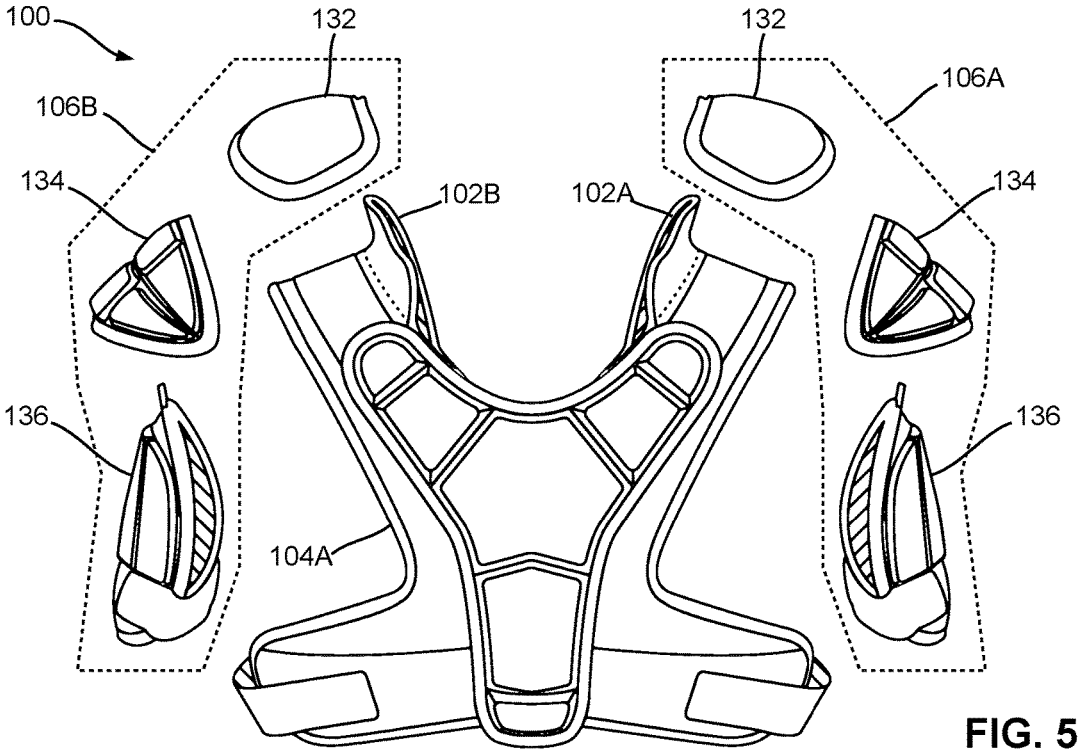
FIG. 5 is an exploded front view of the protective apparatus shown in FIG. 1.
Figure 6:
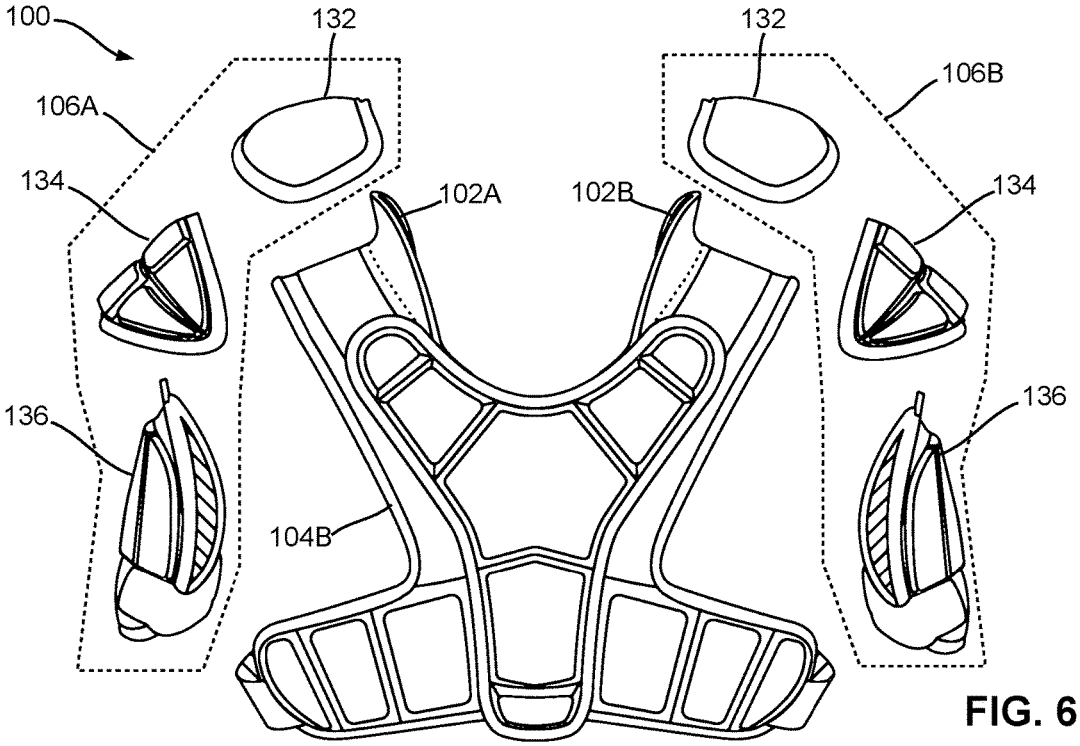
FIG. 6 is an exploded rear view of the protective apparatus shown in FIG. 1.

As shown in FIGS. 5 and 6, each arm-protective structure 106A, 106B comprises an upper shoulder cap 132, a lower shoulder cap 134 flexibly coupled to the upper shoulder cap 132, and a bicep pad 136 flexibly coupled to the lower shoulder cap 134. The upper shoulder cap 132 comprises a rigid foam base and a moulded rigid-plastic sheet enclosed in a fabric cover. The lower shoulder cap 134 comprises a rigid foam base, a moulded rigid-plastic sheet, and a plurality of rigid foam blocks all enclosed in a fabric cover. The bicep pad 136 comprises a rigid foam base, a moulded rigid-plastic sheet, and a plurality of foam blocks, all enclosed in a fabric cover. Each arm-protective structure 106A, 106B may be coupled to the base structure 104 by flexibly attaching the upper shoulder cap 132 thereof to a respective shoulder area of the base structure 104 using suitable means.

Figure 7:
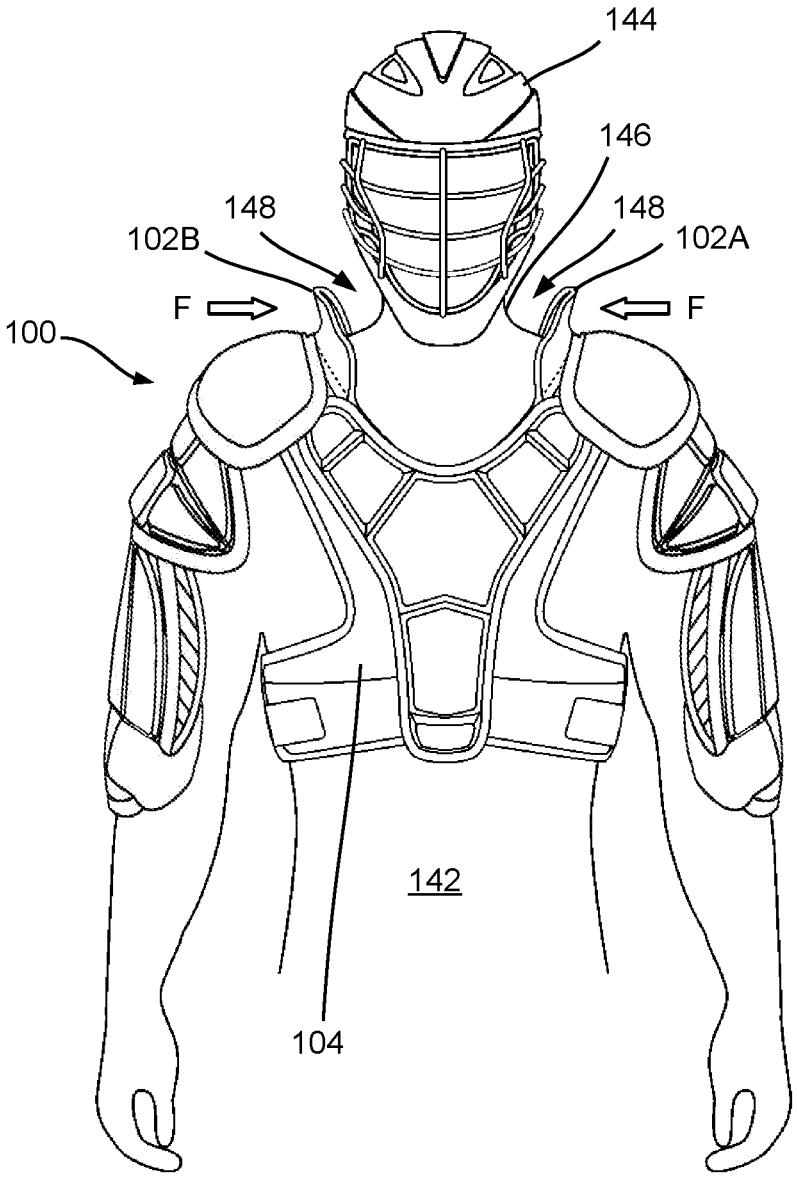
FIG. 7 is a front view of a user wearing the protective apparatus shown in FIG. 1.

FIG. 7 shows a user 142 wearing the protective garment 100 and a helmet 144 for practicing a sport game such as lacrosse. As shown, the neck guards 102A and 102B form a protective shield about the user's neck 146 and at a distance 148 thereto for protecting the user's neck 146 against potential impact forces F while still allowing the user to freely move their head. Moreover, the space 148 between the neck guard 102A, 1021 and the user's neck 146 allows a limited deformation of the neck guards 102A and 1021 in response to impact forces F, thereby further improving impact force absorption.

Figure 8:
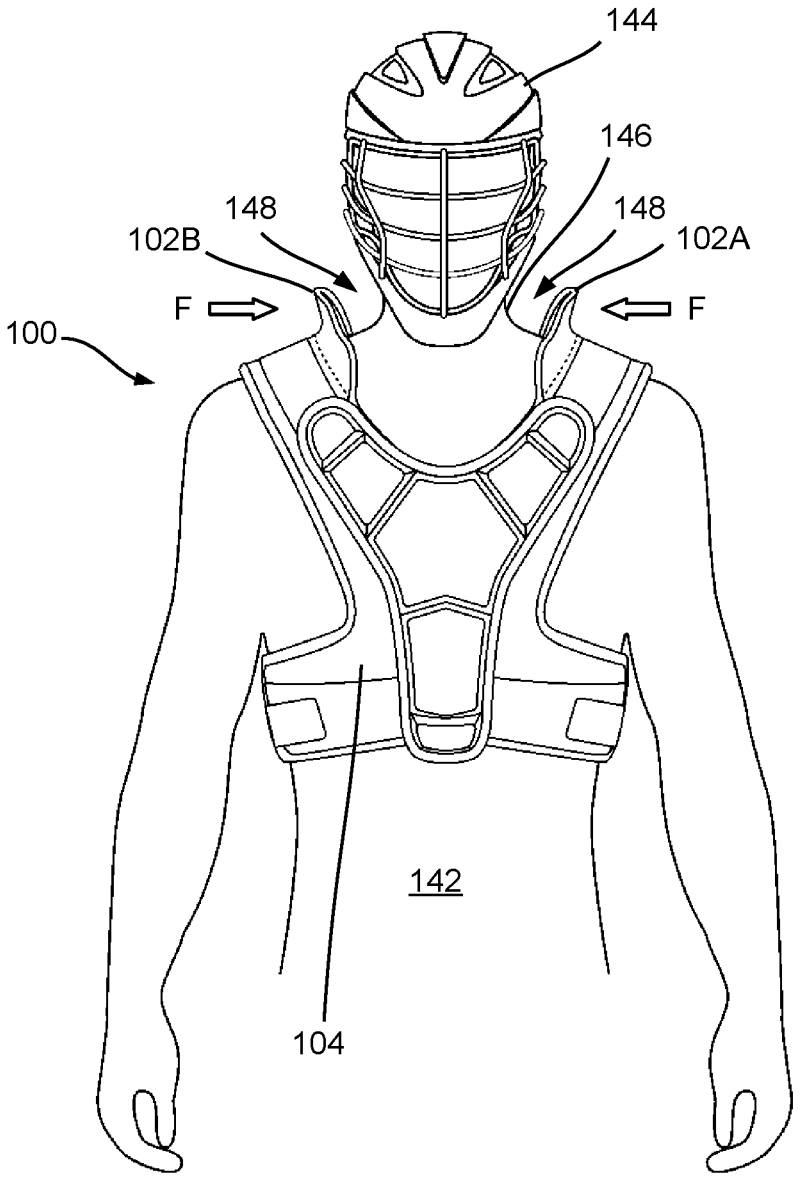
FIG. 8 is a front view of a user wearing the protective apparatus shown in FIG. 1, according to an alternative embodiment.

In an alternative embodiment, the protective garment 100 may not comprise any arm-protective structures. FIG. 8 shows a user 142 wearing such a protective garment 100 and a helmet 144 for practicing a sport game such as hockey.

In some alternative embodiments, the neck-protective structure 102 is removable from the base structure 104.

Figure 9:
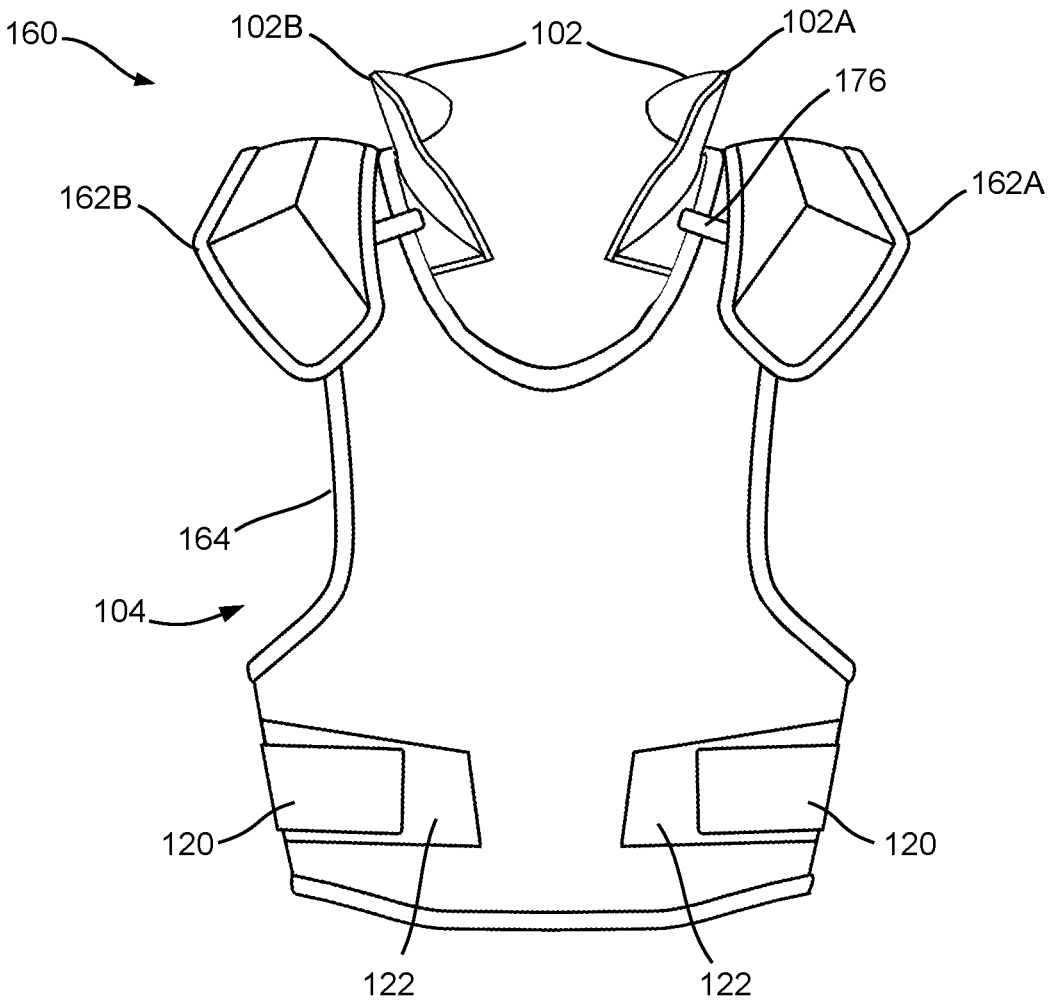
FIG. 9 is a front view of a protective apparatus, according to another embodiment of the present disclosure.

For example, FIG. 9 shows a protective garment 160 comprising a base structure 104 and a neck-protective structure 102 demountably coupled to the base structure 104. In this embodiment, the protective garment 160 does not comprise any arm-protective structures. Rather, the protective garment 160 comprises a pair of shoulder pads 162A and 162B made of rigid foam and coupled to the shoulder portion of the base structure 104.

The base structure 104 in this embodiment comprises a front plate 164 and a rear plate (not shown) similar to the front and rear plate 112 and 116 shown in FIGS. 3 and 4. The lower portions of the front plate 164 and the rear plate may be fastened together using a hook and loop structure 120 and 122 as described above.

Figure 10:
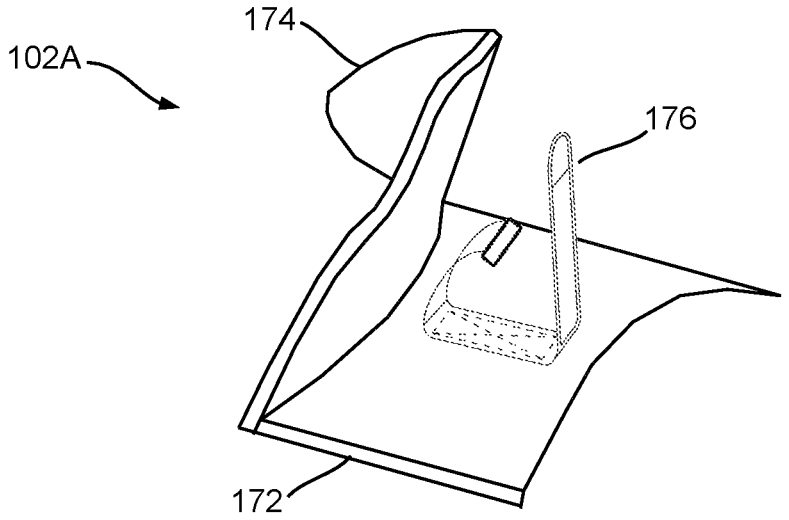
FIG. 10 is a perspective view of a left-hand side neck guard of the protective apparatus shown in FIG. 9.

The neck-protective structure 102 comprises a pair of neck guards 102A and 102B as shown in FIGS. 9 and 10. Each neck guard 102A, 102B comprises a supportive portion 172 and a neck-protection portion 174 extending upwardly and slightly outwardly from a proximal side of the supportive portion 172 at a first angle towards a direction away from the neck area such that the supportive portion 172 and the neck-protection portion 174 form an acute angle therebetween. The supportive portion 172 is curved to substantively adapt to the shape of a shoulder, and comprises one or more fastening structures 176 in the form of one or more strip fasteners for locking the neck guard 102A, 102B to the base structure 104. As shown in FIG. 9, the fastening structure 176 of each neck guard 102A, 102B may wrap about a shoulder portion of the base structure 104 to solidly but demountably fasten the neck guard 102A, 102B thereto.

Figure 12:
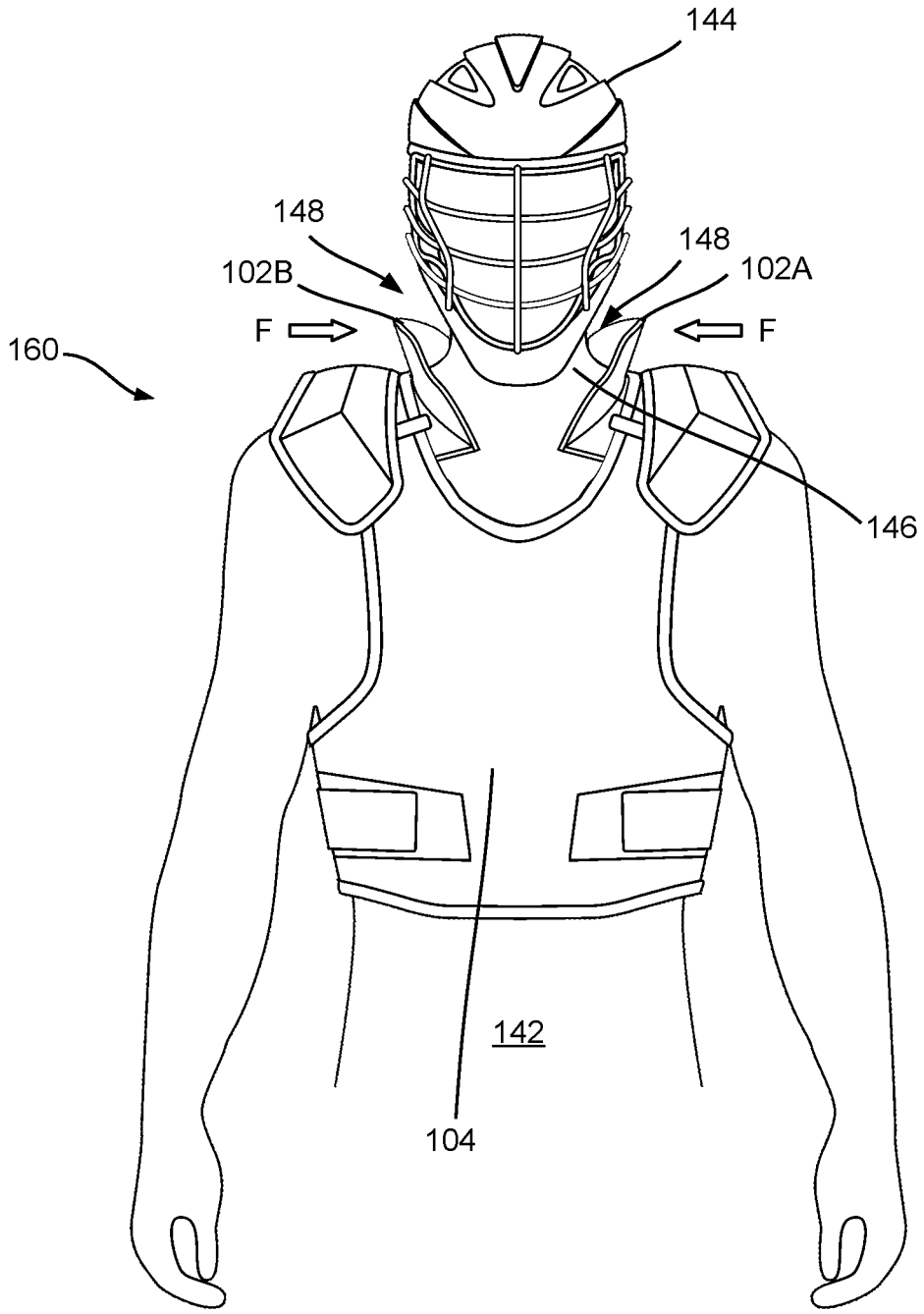
FIG. 12 is a front view of a user wearing the protective apparatus shown in FIG. 9.

FIG. 12 shows a user 142 wearing the protective garment 160 and a helmet 144 for practicing a sport game such as lacrosse. Similar to the protective garment 100 shown in FIGS. 7 and 8, the neck guards 102A and 102B form a protective shield about the user's neck 146 and at a distance 148 thereto for protecting the user's neck 146 from potential risk of injury that may be otherwise caused by impact forces F applied from the left-hand or right-hand side of the body, while still allowing the user to freely move their head. For example, when an object such as a hockey stick (not shown) is directed from a lateral direction towards the user's neck area, the respective neck guard 102A or 102B stops the object, absorbs the impact force F thereof, and safely distributes the impact force F to the base structure 104 without injuring the user's neck.

When the neck guard 102A or 102B stops the impact force-delivering object and absorbs the impact force F thereof, the neck guard 102A or 102B may deform by a limited extent. The space 148 between the neck guards 102A and 102B and the user's neck 146 allows such a limited extent of deformation of the neck guards 102A and 102B in response to impact forces F, thereby further improving impact force absorption.

Those skilled in the art will appreciate that cushion materials may be used in the neck-protective structure 102, base structure 104 and/or arm-protective structures 106A and 106B as needed for comfort. The fabric covers of the structures 102, 104, 106A and/or 106B may be painted, dyed or otherwise colored with suitable bright color(s) and/or suitable pattern(s) for advertisement or for warning other people or players to avoid hitting opponents from behind.

Figure 13:
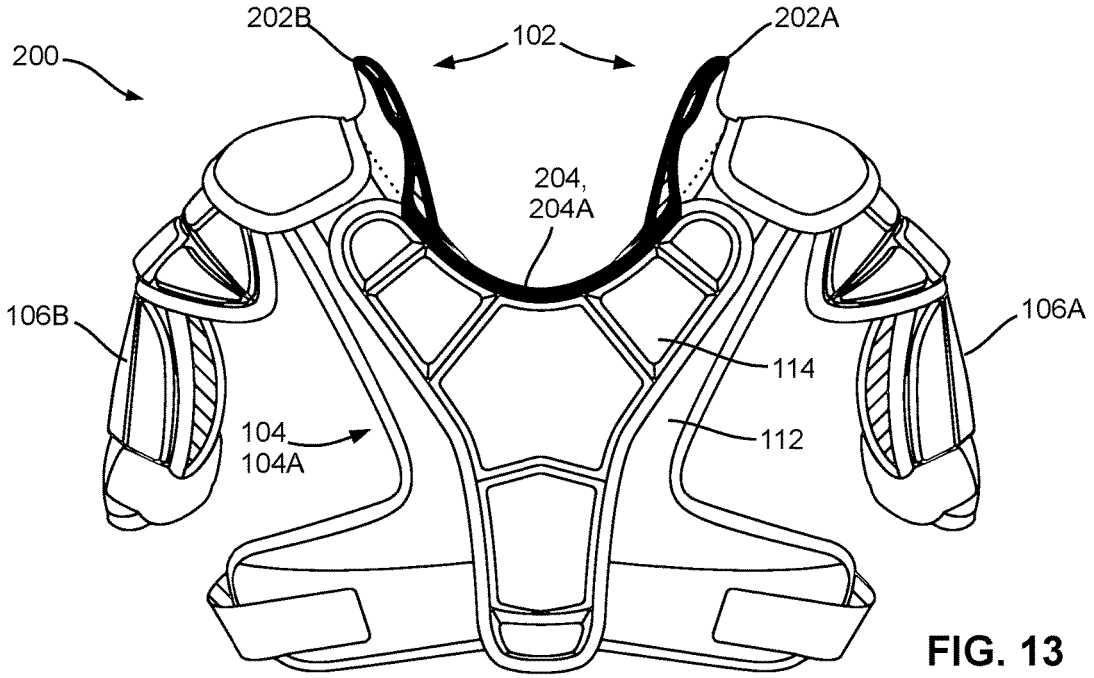
FIG. 13 is a front view of a protective apparatus, according to yet another embodiment of the present disclosure.
Figure 14:
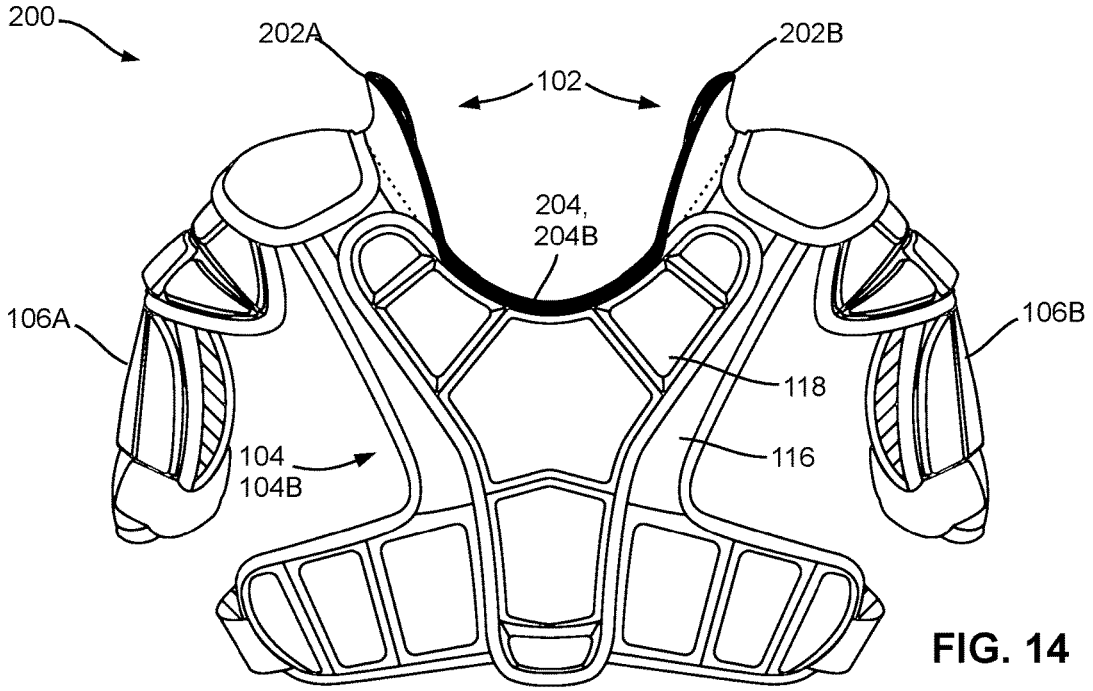
FIG. 14 is a rear view of the protective apparatus shown in FIG. 13.

FIGS. 13 and 14 show a protective garment 200 according to an alternative embodiment. The protective garment 200 is similar to the protective garment 100 shown in FIGS. 1 and 2, and comprises a base structure 104 about the user's torso area, a neck-protective structure 102 about the user's neck area and coupled to the base structure 104, and two arm-protective structures 106A and 16B each about an arm of the user and coupled to the base structure 104.

In this embodiment, the base structure 104 comprises a base frame structure 204 enclosed in the fabric cover. The base frame structure 204 is formed by a laterally-extending curved front base frame 204A adjacent and extending along the user's chest area, and a laterally-extending curved rear base frame 204B adjacent and extending along an upper portion of the user's back. The base frames 204A and 204B are made of a rigid material such as steel with sufficient strength for absorbing impact forces or hits without significant deformation.

Similar to the base structure 104 of the protective garment 100 shown in FIGS. 1 and 2, the base structure 104 of the protective garment 200 also comprises a front W portion 104A and a rear portion 104B. The front portion 104A comprises a rigid front plate 112 about the user's chest area and a rigid front sternum pad 114 attached to the front plate 112. The rear portion 104B comprises a rigid rear plate 116 about the user's back area and a rigid rear sternum pad 118 attached to the rear plate 116.

The neck-protective structure 102 comprises a left-hand side protective frame 202A and a right-hand side protective frame 202B enclosed in the fabric cover. The protective frames 202A and 202B are made of a rigid material such as steel rods with sufficient strength for absorbing impact forces or hits without significant deformation.

Figure 15:
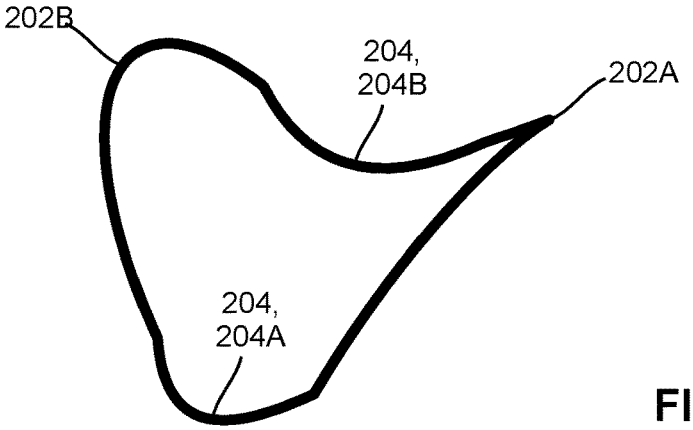
FIG. 15 is a perspective view of frames in a base structure and a neck-protective structure of the protective apparatus shown in FIG. 13.

The left-hand side protective frame 202A is coupled to the left-hand side of the base frame structure 204 such as the left ends of the base frames 204A and 104B, and extends upwardly and slightly outwardly at the first angle towards a direction away from the neck area. Similarly, the right-hand side protective frame 202B is coupled to the right-hand side of the base frame structure 204 such as the right ends of the base frames 204A and 204B, and extends upwardly and slightly outwardly at the first angle towards a direction away from the neck area. FIG. 15 is a perspective view of the frames 202A, 202B, 204A, and 204B.

The neck-protective structure 102 and the base structure 104 may further comprise cushion materials covering the frames 202A, 202B, 204A, and 204B, and may be enclosed in the respective fabric covers for comfort. As described above, the fabric covers may be painted, dyed or otherwise colored with suitable bright color(s) and/or suitable patten(s) for advertisement or for warning other people or players to avoid hitting opponents from behind.

Figure 16:
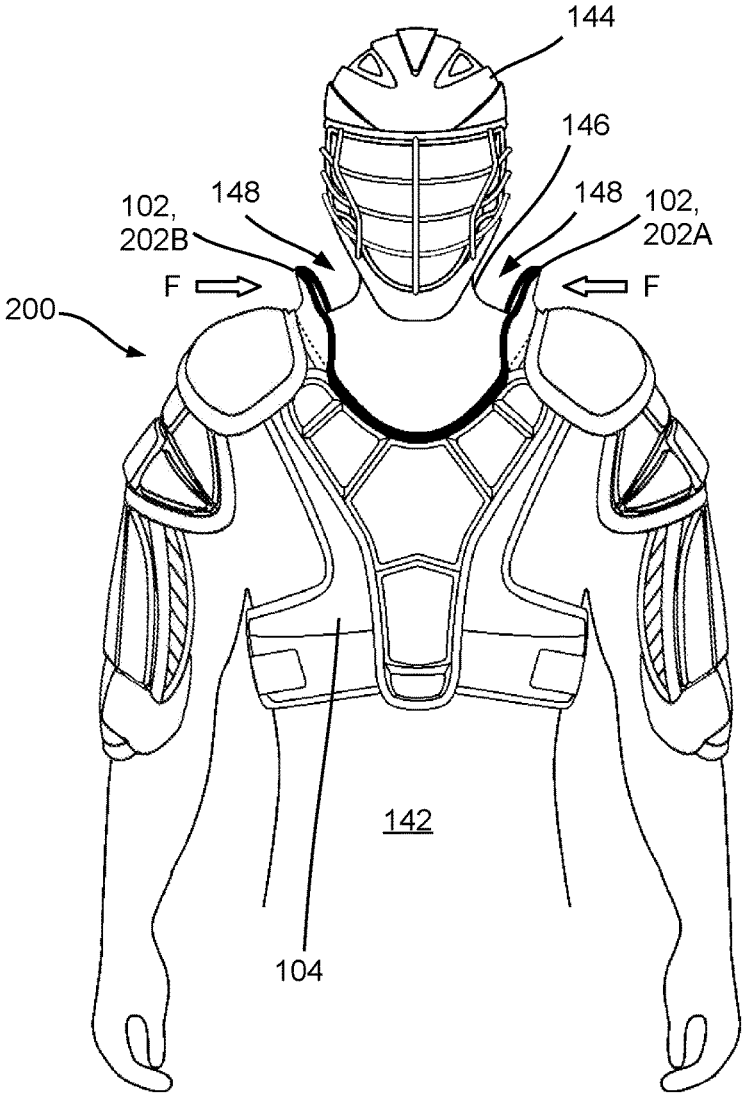
FIG. 16 is a front view of a user wearing the protective apparatus shown in FIG. 13.

A shown in FIG. 16, the neck-protective structure 102, and in particular the protective frames 202A and 202B form a protective shield about the user's neck 146 and at a distance 148 thereto for protecting the user's neck 146 against potential impact forces F applied from the left- or right-hand side of the body while still allowing the user to freely move their head. Moreover, the space between the protective frames (202A and 202B) and the user's neck allows a limited deformation of the frames 202A and 202B in response to impact forces F, thereby further improving impact force absorption. In addition, the outward extension of the protective frames 202A and 202B allows short base frames 204A and 204B, thereby reducing the weight of the protective garment 200.

In this embodiment, the front base frame 202A is preferably located at a relatively lower position of the user's upper body such as about the user's chest with sufficient distance to the user's neck, to allow more space for the user to lower their head towards front, as the user may often do. On the other hand, by recognizing that a person's head can only move a limited, range towards the back, the rear base frame 202B may be preferably located at a relatively higher position of the user's upper body, for example, at a height about the user's shoulders, to provide more protection against potential impact forces from behind. The protective garment 200 thus protects the user's neck area while still providing the user with sufficient mobility and field of vision without impeding the player's normal functions in game playing.

The protective frames 202A and 202B thus protects the user's neck area from the risk of injury. When an object such as a hockey stick (not shown) is waving from a lateral direction towards the user's neck area, the respective protective frame 202A or 202B stops the object, absorbs the impact force F thereof, and safely distributes the impact force F to the base frames 104A and 104B without injuring the user's neck.

When the protective frame 202A or 202B stops the object and absorbs the impact force F thereof, the protective frame 202A or 202B may deform by a limited extent. The space 148 between the protective frame 202A or 202B and the user's neck 146 allows such a limited extent of deformation of the protective frame 202A or 202B in response to impact forces F, thereby further improving impact force absorption.

Figure 17:
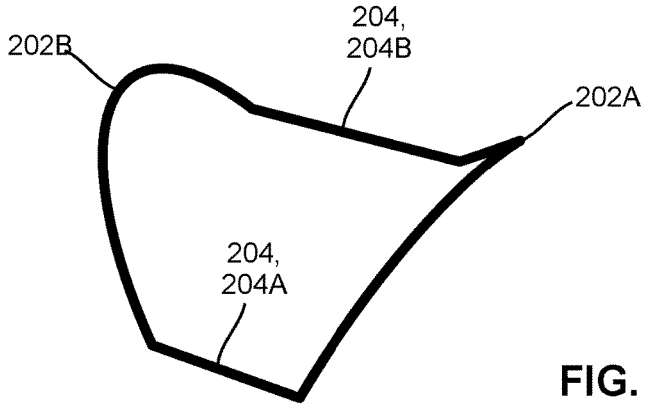
FIG. 17 is a perspective view of frames in a base structure and a neck-protective structure of the protective apparatus shown in FIG. 13, according to still another embodiment of the present disclosure.

In an alternative embodiment, the base frame structure 204 is formed by straight front and rear base frames 204A and 204B, as shown in FIG. 17.

In above embodiments, a user may first wear a clothing, such as a sports jersey, and then wear the protective garment 100, 160, or 200 on top of the jersey on an upper body thereof and about the user's neck area.

In some alternative embodiments, the user may wear the protective garment 100, 160, or 200 under a sports jersey.

In some embodiments, the protective garment 100, 160, or 200 may also comprise suitable means such as a quick strap connector for further coupling to other protective equipment such as kidney pads.

In another embodiment, the protective garment 100, 160, or 200 is manufactured in the form of a protective clothing, in which the neck-protective structure 102, the base structure 104, and the arm-protective structure 1-6 are coupled to the clothing thereunder. In above embodiments, the neck-protective structure 102 extends upwardly and slightly outwardly only along the left and right sides of the neck area.

Figure 18:
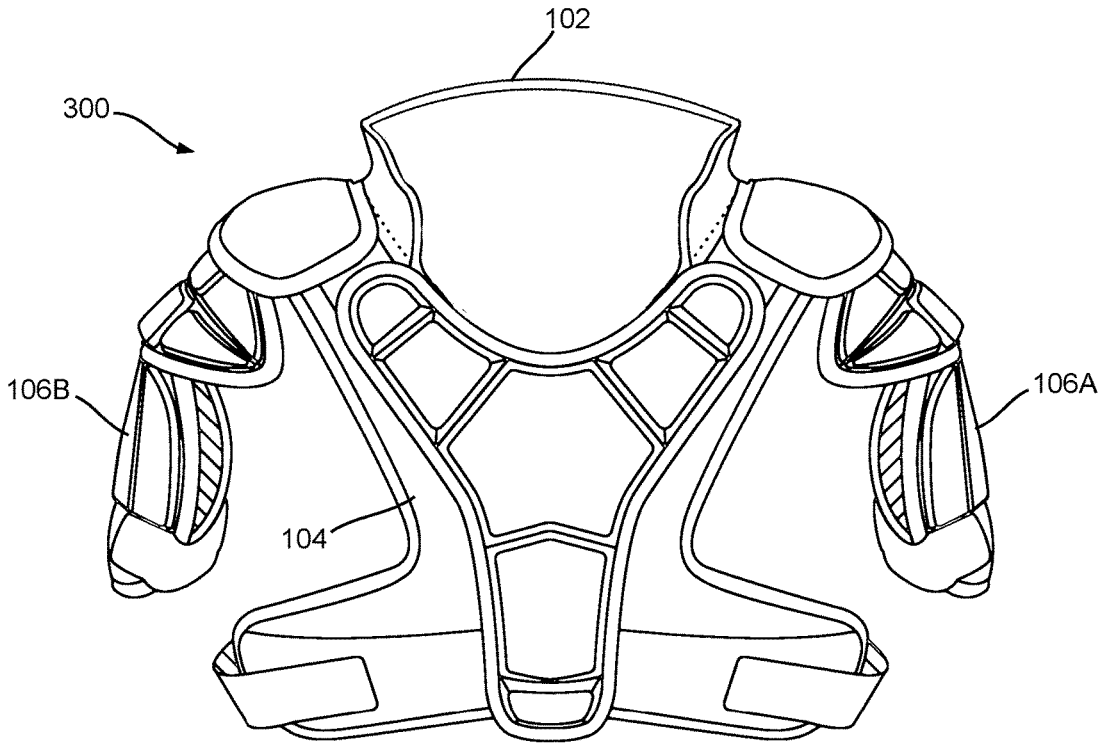
FIG. 18 is a front view of a protective apparatus, according to another embodiment.

In another embodiment as shown in FIG. 18, the neck-protective structure 102 of a protective garment 300 may also extend from the base structure 104 upwardly and slightly outwardly along the rear side of the neck area to also provide protection to the rear side of the neck area. The base structure 104 and the arm-protective structures 106A and 106B in this embodiment are the same as those shown in FIGS. 1 and 2.

Figure 19:
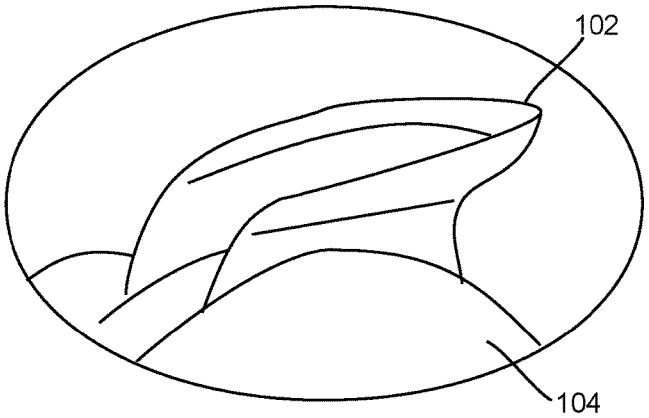
FIG. 19 is a perspective view showing a portion of a protective apparatus, according to another embodiment.

In another embodiment as shown in FIG. 19, the neck-protective structure 102 first extends from the base structure 104 upwardly and slightly outwardly at the first angle along the left, right, and rear sides of the neck area to a first height for example about the middle of the user's neck, and then further extends upwardly and outwardly at a second, larger angle to a second height to provide protection to the user's head against uppercuts. The transition from the first outward angle to the second upward angle is preferably a smooth transition. However, the transition from the first outward angle to the second upward angle may be abrupt in some alternative embodiments.

In another embodiment, the second height is higher than the first height.

Figure 20:
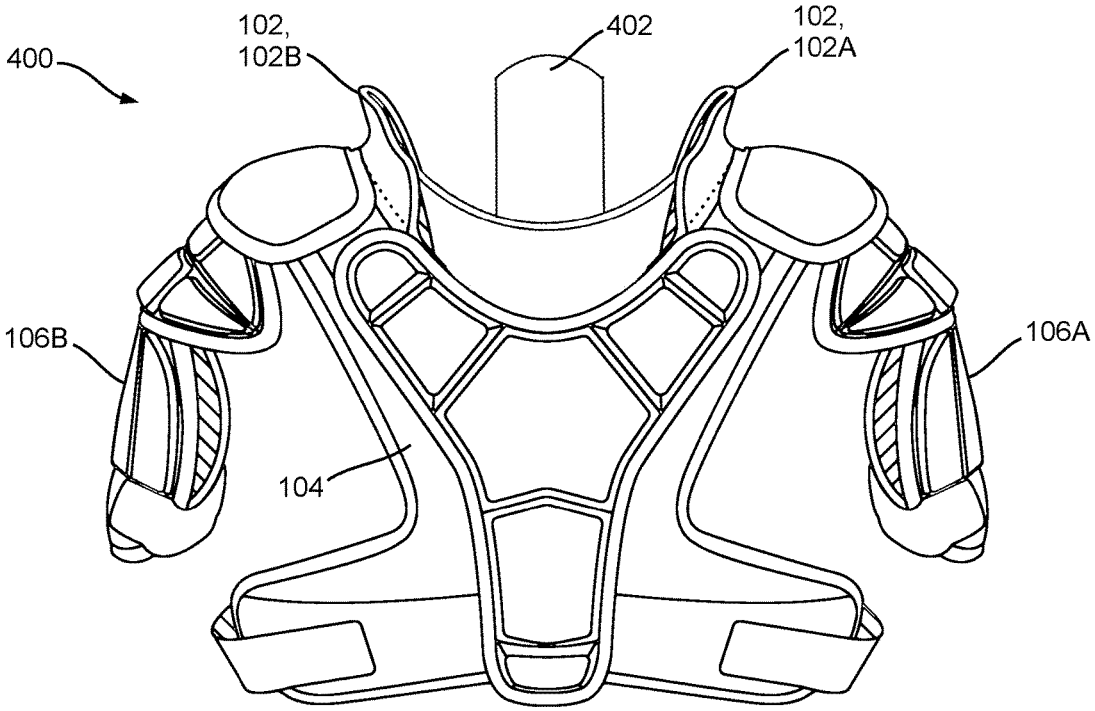
FIG. 20 is a front view of a protective apparatus, according to another embodiment.

In some alternative embodiments as shown in FIG. 20, a protective garment 400 may further comprise a neck and spinal column protection structure 402 (also denoted as "a neck-vertebrae protection structure" hereinafter), extending along the user's neck and spinal column from the base structure 104 upwardly and slightly outwardly to about a lower area of the user's head. The other components of the protective garment 400 are the same or similar as those of the protective garment 100 shown in FIGS. 1 and 2.

In one embodiment, the neck-vertebrae protection structure 402 is fixed to the base portion 104. In another embodiment, the neck-vertebrae protection structure 402 is removably coupled to the base portion 104. Similar to the neck-protective structure 102, the neck-vertebrae protection structure 402 may be made of a rigid material with sufficient strength.

In one embodiment, the neck-vertebrae protection structure 402 may be coupled to the base structure 104 at a rear side thereof and extend along a user's neck-vertebrae area. The neck-vertebrae protection structure 402 may comprise an elastic or spring structure, and is rotatable between a first, unbiased position and a second, biased position rear to the first position. The neck-vertebrae protection structure 402 may further comprise a delimit structure to prevent the neck-vertebrae protection structure 402 to move from the second position beyond the first position. Therefore, the neck-vertebrae protection structure 402 may be biased by a biasing force for example, by the rearward moving of the user's head, to transit from the first position to the second position, and may return to the first position after the biasing force is removed. On the other hand, when an impact force hits the neck-vertebrae protection structure 402 from behind, the delimit structure prevents the neck-vertebrae protection structure 402 from biasing towards front, thereby protecting the user's neck from injury.

Figure 21:
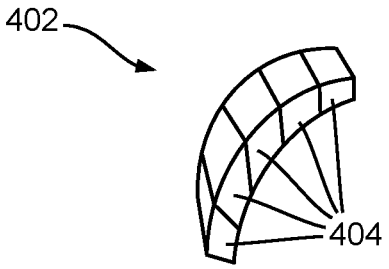
FIGS. 21 and 22 are perspective views of neck and spinal column protection structure of the protective apparatus shown in FIG. 20.
Figure 22:
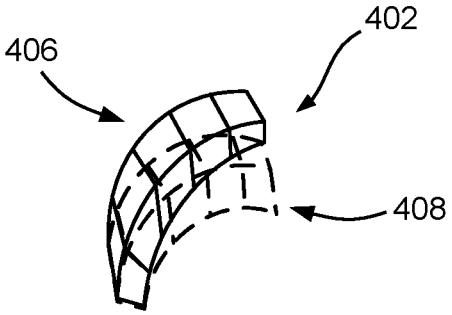

In another embodiment, the neck-vertebrae protection structure 402 comprises an articulating structure. For example, FIGS. 21 and 22 show a neck-vertebrae protection structure 402 comprising a plurality of protection pieces 404, rotatably coupled to one another in such a way that the neck-vertebrae protection structure 402 can only be rotated between a first, unbiased position 406 and a second, biased position 408 rear to the first position 406. Rotation of the neck-vertebrae protection structure 402 towards front is delimited by a delimit structure (not shown) to prevent the neck-vertebrae protection structure 402 beyond the first position 406, thereby protecting the user's neck from potential impact forces hitting from behind.

In some of above embodiments, the neck-protective structure 102 and the base structure 104 comprise frames 202A, 202B, 204A, and 204B at the edges of the respective structures. In these embodiments, the neck-protective structure 102 does not comprise any rigid foam layer as the protective frames 202A and 202B may be sufficient for resisting impact forces applied by a wielded stick and distributing the impact threes to the base structure 104.

However, such a protective garment may not provide sufficient protection against impact forces applied to a center location of the neck-protective structure 102 or the neck-vertebrae protection structure 402. Therefore in some embodiments, the neck-protective structure 102 and/or the neck-vertebrae protection structure 402 may also comprise a plurality of rigid foam layers and a plastic outer layer enclosed in a fabric cover for providing enhanced impact resistance and for improved impact distribution to the base structure 104.

Figure 23:
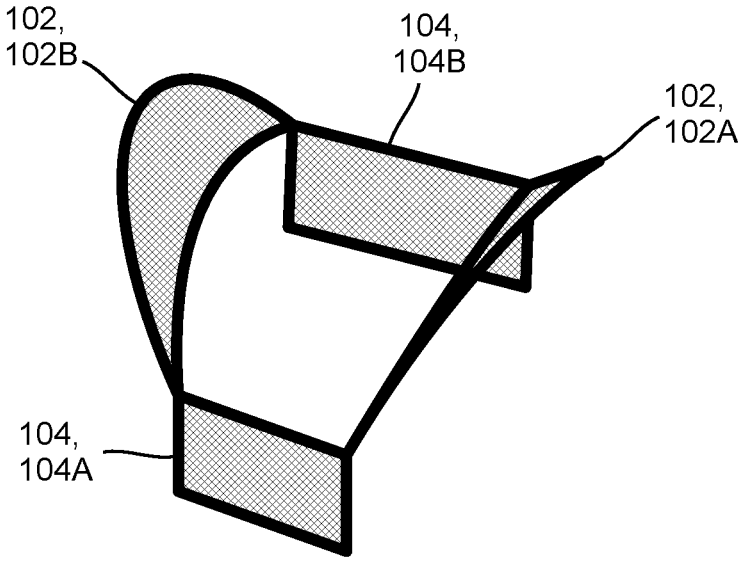
FIG. 23 is a perspective view of a mesh-like or lattice-like structure of a protective apparatus, according to another embodiment.

In an alternative embodiment as shown in FIG. 23, at least one of the neck-protective structure 102, the base structure 104, and the neck-vertebrae protection structure (not shown) comprises a mesh-like or lattice-like structure made of a material with sufficient strength, to provide enhanced protection against impact forces. A lattice-like base structure 104 may also provide better, for example, more uniform, impact-force distribution and absorption.

In some alternative embodiments, the frames 202A, 202B, 204A, and 204B may be made of other suitable solid material with sufficient rigidity such as aluminum, wood, hard plastic, rigid foam, carbon fiber, fiber glass, the like, and combinations thereof.

In some of above embodiments, the neck-protective structure 102, the base structure 104, and/or the neck-vertebrae protection structure 402 comprise rigid foam plates or layers for impact resistance. In some alternative embodiments, such plates or layers may be made of other suitable rigid material such as aluminum, steel, wood, hard plastic, carbon fiber, the like, and combinations thereof. In one embodiment, the plates or layers are made of a same or similar rigid material. In another embodiment, the plates or layers are made of different materials.

In an alternative embodiment, the neck-protective structure 102, the base structure 104, and/or the neck-vertebrae protection structure 402 may be made of rigid plates configured to selected desired shapes to fit around body torso and appendage elements, and does not comprise any frames.

In some alternative embodiments, the neck-protective structure 102 may extend upwardly from the base structure 104 at other suitable angles. For example, in one embodiment, the neck-protective structure 102 may extend upwardly from the base structure 104 at 90°. In another embodiment, the neck-protective structure 102 may extend upwardly and slightly inwardly towards the neck area.

Those skilled in the art will appreciate that in various embodiments, the arm-protective structures 106A and 106B may be optional. For example, in some embodiments such as those shown in FIGS. 8 and 12, the protective apparatus does not comprise any arm-protective structure. In some alternative embodiments, the protective apparatus may only comprise one arm-protective structure 106A or 106B.

Those skilled in the art will appreciate that the protective apparatus or garment disclosed herein may be used with other protective equipment such as helmet, gloves, cleats, and the like, for full body protection as the user desires and/or needs.

Figure 24:
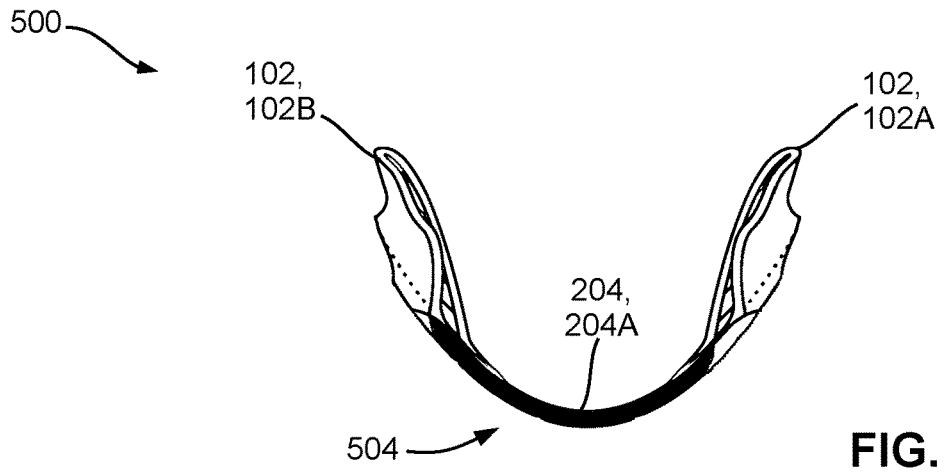
FIG. 24 is a front view of a protective apparatus, according to another embodiment.

FIG. 24 shows a neck protective apparatus 500 in an alternative embodiment. The neck protective apparatus 500 comprises a neck-protective structure 102 and a base structure 504. The neck-protective structure 102 is similar to that shown in FIG. 1 and comprises a pair of neck guards 102A and 102B. However, the base structure 504 in this embodiment only comprises a frame structure. 204 having a laterally-extending front frame 204A and a laterally-extending rear frame 204B, similar to those shown in FIG. 13. The front and rear frames 204A and 204B are coupled to the neck guards 102A and 102B for providing support thereto and for absorbing impact forces distributed therefrom.

Figure 25:
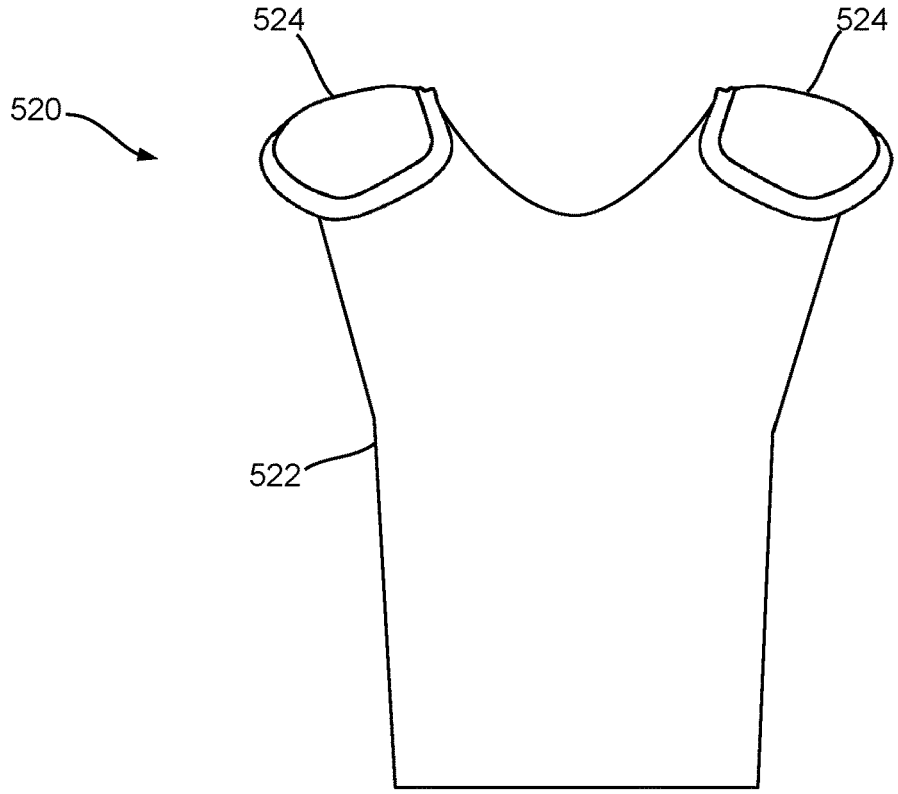
FIG. 25 (Prior art)
FIG. 25 is a front view of a prior-art protective jersey.
Figure 26:
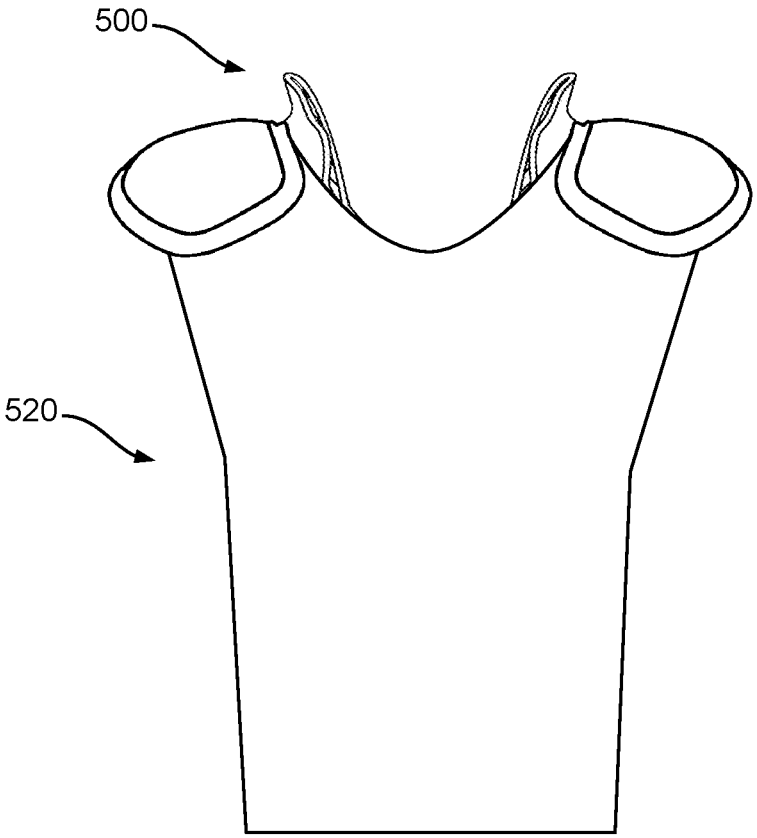
FIG. 26 is a front view of a protective jersey provided with a neck protective apparatus according to another embodiment of the present disclosure.
Figure 27:
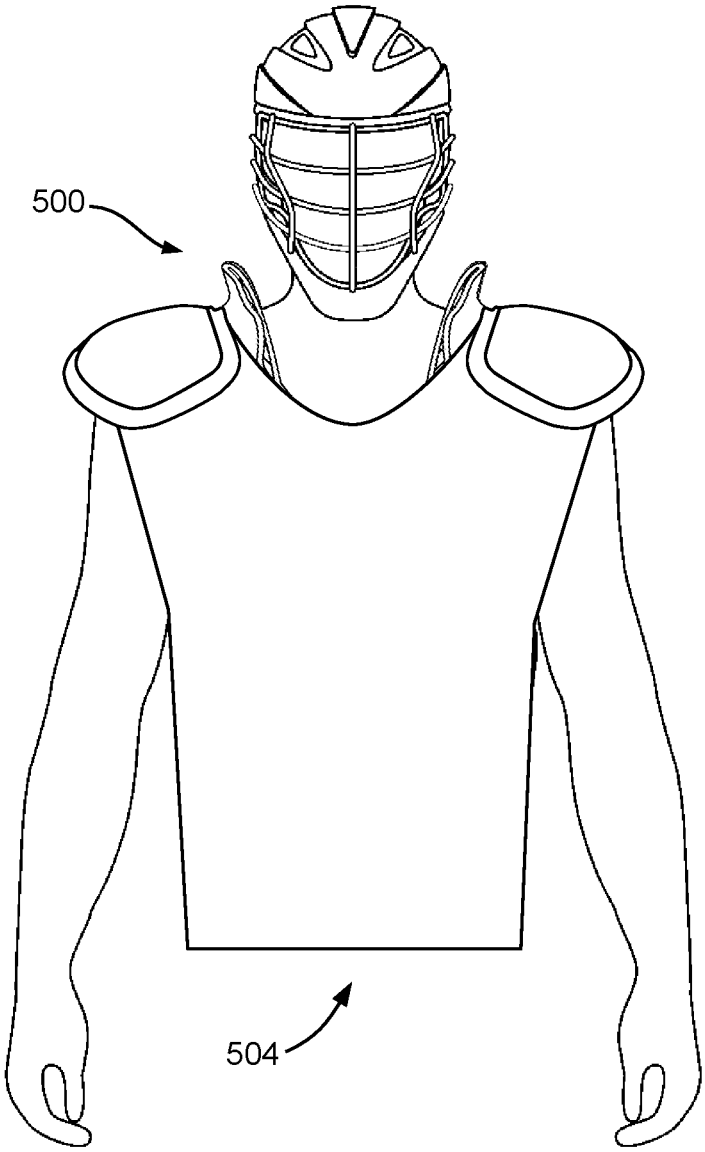
FIG. 27 is a front view of a user wearing the protective jersey shown in FIG. 26.

The neck protective apparatus 500 may be worn by a user with a prior-art protective apparel or jersey comprising at least a rigid portion for supporting the neck-protective structure 102. For example, FIG. 25 shows a prior-art protective jersey 520 having a shirt 522 and a rigid portion in form of a pair of shoulder pad 524 that may be substantively steadily coupled to an upper body of a user. As shown in FIG. 26, the neck protective apparatus 500 may be integrally or removably coupled to the protective jersey 520 by suitable means such as straps, screws, hooks, and/or the like such that the protective jersey 520 also forms a part of the base structure (i.e., together with the base structure 504). FIG. 27 shows a user wearing the neck protective apparatus 500 and the jersey 520.

In an alternative embodiment, the neck protective apparatus 500 may be directly fastened, tied, or otherwise coupled to an upper body of a user via a suitable coupling structure such as one or more straps. Thus in this embodiment, the coupling structure also forms a part of the base structure (i.e., together with the base structure 504), and the prior-art jersey 520 is not required.

Figure 11:
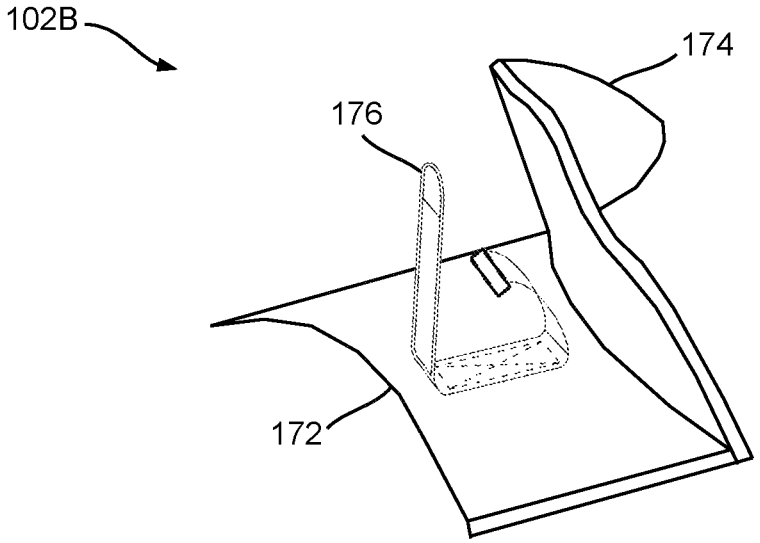
FIG. 11 is a perspective view of a right-hand side neck guard of the protective apparatus shown in FIG. 9.

In an alternative embodiment, the neck protective apparatus comprises a pair of neck guards such as the neck guards 102A and 102B shown in FIGS. 10 and 11. The base structure in this embodiment is a prior-art protective garment such as the prior-art protective garment shown in FIG. 26.

Figure 28:
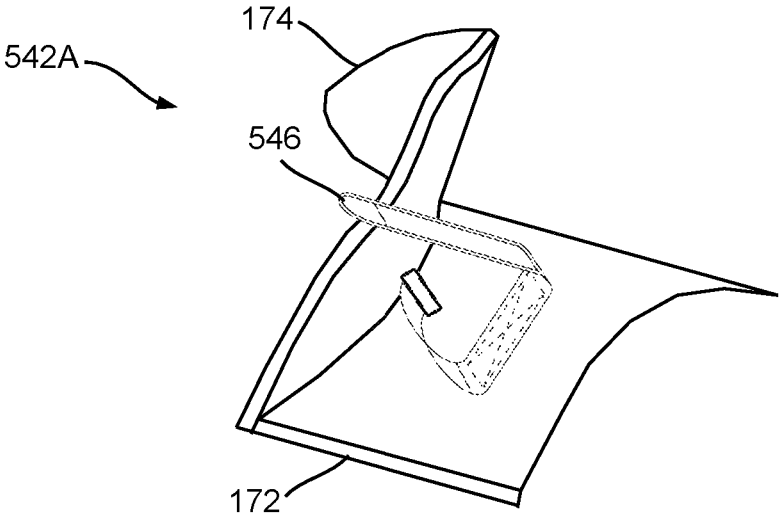
FIG. 28 is a perspective view of a left-hand side neck guard of the neck protective apparatus shown in FIG. 26.
Figure 29:
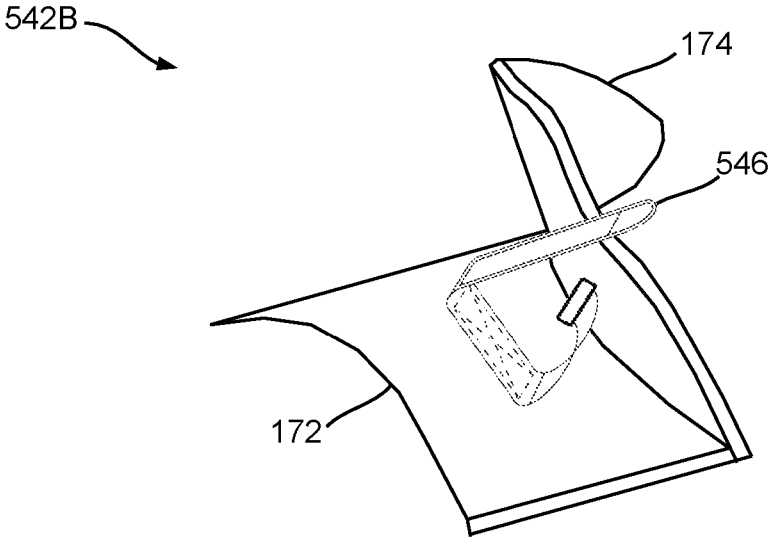
FIG. 29 is a perspective view of a right-hand side neck guard of the neck protective apparatus shown in FIG. 26.

In an alternative embodiment, the neck protective apparatus comprises a pair of neck guards 542A and 542B as shown in FIGS. 28 and 29. The neck guards 542A and 542B are similar to the neck guards 102A and 102B shown in FIGS. 10 and 11, respectively. As shown in FIGS. 28 and 29, each of the neck guards 542A and 542B comprises a coupling structure such as a strap 546 suitable for wrapping about an arm adjacent the respective shoulder for tying the neck guard 542A, 542B to the user's upper body or more specifically the shoulder. In this embodiment, the neck-protection portions 174 form a neck-protective structure for absorbing impact forces delivered thereto, and the supportive portions 172 and the coupling structure 546 form a base structure for supporting the neck-protective structure, absorbing impact forces received from the neck-protective structure, and distributing the received impact forces to the user's upper body.

The neck protective apparatus disclosed herein is suitable for providing sufficient protection to user's neck in various use scenarios such as contact sports. For example, the protective apparatus disclosed herein is suitable for protecting young lacrosse players from risk of neck injury, and thus can help grow the sport because players are confident that they will be able to compete and play the game with a reduced risk of injury.

The neck protective apparatus disclosed herein is also suitable for protecting players in other contact games such as ice hockey. The protective apparatus can help limit the trauma caused by a stick striking the player's neck and thus keep the player on the field of play.

As described above, the protective apparatus disclosed herein is particularly useful for protecting young players. Keeping the youth of today safe in a contact sports will foster growth for the sport and ultimately produce a well-rounded generation to come.

Those skilled in this art will appreciate that the protective apparatus disclosed herein may be adapted for protecting players in other sports such as womens' lacrosse that have risk of injuries and in particular, risk of neck injuries.

Those skilled in this art will also understand that the protective apparatus disclosed herein may also be adapted for use by workers in work environments wherein there is risk of significant impact forces to or about a worker's neck area. For example, in construction, in rigging for lifting and/or moving heavy objects or equipment, on drilling rigs, and the like.

Although embodiments have been described above with reference to the accompanying drawings, those of skill in the art will appreciate that variations and modifications may be made without departing from the scope thereof as defined by the appended claims.

What is claimed is:

1. An apparatus for protecting a user's neck area, the apparatus comprising:

a rigid neck-protective structure forming a protective shield about at least a left-hand side and a right-hand side of the neck area at a distance thereto, for bearing and absorbing impact forces towards said neck area at least from said left-hand or said right-hand side thereof without restricting mobility of the user's neck at least on said left-hand or said right-hand side thereof; and a base structure coupled to the neck-protective structure and demountably attachable to an upper body area of the user for supporting the neck-protective structure and for absorbing the impact forces distributed from the neck-protective structure.

2. The apparatus of claim 1 wherein the neck-protective structure is made of a first rigid material, and the base structure is made of a second rigid material.

3. The apparatus of claim 2 wherein the first or second rigid material is aluminum, steel, wood, hard plastic, solid foam, carbon fiber, or a combination thereof.

4. The apparatus of claim 1 wherein on each of a left-hand side and a right-hand side of the base structure, the neck-protective structure extends upwardly and outwardly at a first angle away from the neck area and extends from a front side thereof to a rear side thereof.

5. The apparatus of claim 1 wherein the neck-protective structure extends upwardly and outwardly from a left-hand side and a right-hand side of the base structure at a first angle to a first height, and then extends upwardly and outwardly at a second angle away from the neck area to a second height.

6. The apparatus of claim 5 wherein the second angle is greater than the first angle, and the second height is higher than the first height.

7. The apparatus of claim 1 wherein at least one of the neck-protective structure and the base structure is enclosed in a fabric cover or a plastic cover or a rubberized cover.

8. The apparatus of claim 1 further comprising:

one or two arm-protective structures coupled to the base structure.

9. The apparatus of claim 1 further comprising:

a neck-vertebrae protection structure made of a third rigid material and extending upwardly and slightly outwardly along a rear side of the user's neck area from the base structure.

10. The apparatus of claim 9 wherein the third rigid material is aluminum, steel, wood, hard plastic, solid foam, carbon fiber, and combinations thereof.

11. The apparatus of claim 9 wherein the neck-vertebrae protection structure is integrally coupled to the base structure.

12. The apparatus of claim 9 wherein the neck-vertebrae protection structure is demountably coupled to the base structure.

13. The apparatus of claim 1 wherein the neck-protective structure is integrally coupled to the base structure.

14. The apparatus of claim 1 wherein the neck-protective structure is demountably coupled to the base structure.

15. The apparatus of claim 14 wherein the neck-protective structure comprises a fastening structure for demountably coupling the neck-protective structure to the base structure.

16. The apparatus of claim 1 wherein the base structure comprises a front portion and a rear portion, and each of the front and rear portions comprises a base frame laterally continuously extending from a left-hand side thereof to a right-hand side thereof;

wherein the neck-protective structure comprises a left-hand side neck-protective portion and a right-hand side neck-protective portion, and each of the left- and right-hand side neck-protective portions comprises a protective frame coupled to the base frames.

17. The apparatus of claim 1 wherein the base structure is a protective apparel comprising at least a rigid portion for supporting the neck-protective structure.

18. An apparatus for protecting a user's neck area, the apparatus comprising:

a rigid neck-protective structure demountably attachable to an upper body area of the user for forming a protective shield about at least a left-hand side and a right-hand side of said neck area at a distance thereto, for bearing and absorbing impact forces towards said neck area at least from said left-hand or said right-hand side thereof without restricting mobility of the user's neck at least on said left-hand or said right-hand side thereof.

19. The apparatus of claim 18 further comprising:

a base structure coupled to the neck-protective structure and demountably attachable to the upper body area of the user for supporting the neck-protective structure and for absorbing the impact forces distributed from the neck-protective structure;

wherein the neck-protective structure is demountably attachable to the upper body area of the user via the base structure.

20. The apparatus of claim 19, wherein on each of a left-hand side and a right-hand side of the base structure, the neck-protective structure extends from said side upwardly and outwardly away from the neck area and extends from a front side thereof to a rear side thereof.

* * * * *